US011193736B2

(12) United States Patent
Pope et al.

(10) Patent No.: US 11,193,736 B2
(45) Date of Patent: Dec. 7, 2021

(54) ROBOTIC DEVICES WITH SAFETY RETENTION SUITS FOR REDUCING BALLISTIC RISKS

(71) Applicant: DISNEY ENTERPRISES, INC., Burbank, CA (US)

(72) Inventors: Morgan T. Pope, Burbank, CA (US); Brian Orr, Winter Garden, FL (US); Maxime Leboeuf, Glendale, CA (US)

(73) Assignee: Disney Enterprises, Inc., Burbank, CA (US)

( * ) Notice: Subject to any disclaimer, the term of this patent is extended or adjusted under 35 U.S.C. 154(b) by 323 days.

(21) Appl. No.: 16/559,839

(22) Filed: Sep. 4, 2019

(65) Prior Publication Data

US 2021/0063118 A1 Mar. 4, 2021

(51) Int. Cl.
*B25J 19/00* (2006.01)
*F41H 5/04* (2006.01)

(52) U.S. Cl.
CPC ..... *F41H 5/0478* (2013.01)

(58) Field of Classification Search
CPC ..... F41H 5/0478; F41H 5/0485; F41H 1/02; B25J 19/0075
See application file for complete search history.

(56) References Cited

U.S. PATENT DOCUMENTS

2008/0047662 A1* 2/2008 Dria ..... G01B 7/16 156/249
2010/0292707 A1* 11/2010 Ortmaier ..... A61B 46/10 606/130
2017/0217025 A1* 8/2017 Okada ..... B25J 17/00
2018/0085860 A1* 3/2018 Krajca ..... B25J 19/0075
2018/0200014 A1* 7/2018 Bonny ..... A61B 34/30
2019/0321989 A1* 10/2019 Anderson ..... B25J 19/0075
2020/0055181 A1* 2/2020 Caron L'Ecuyer .... B25J 9/0009
2020/0290218 A1* 9/2020 Hannig ..... B25J 11/0075
2020/0361081 A1* 11/2020 Caron L'Ecuyer ..... B25J 18/00

FOREIGN PATENT DOCUMENTS

WO WO-2013159932 A1 * 10/2013 ..... B25J 19/0075

* cited by examiner

*Primary Examiner* — Tajash D Patel
(74) *Attorney, Agent, or Firm* — Snell & Wilmer L.L.P.; Kent A. Lembke

(57) ABSTRACT

A robot system designed to provide non-invasive mitigation of ballistic safety risks. The robot system includes a robotic device and a safety retention suit, which covers or encloses the movable components or parts of the robotic device. The safety retention suit is formed of a fabric sheet of material chosen, in part, for its flexibility as well as durability to allow the part or the component of the robot enclosed within the suit to move freely. The safety retention suit includes one-to-many strands, threads, or cables of a material chosen to move with the flexible material of the suit when the enclosed component of the robotic device is moving during standard operations. When a mechanical failure occurs, the cables of the suit stretch but, as an overall unit, do not break so as to retain any portions of the covered or enclosed robotic part within the suit.

18 Claims, 7 Drawing Sheets

ROBOTIC DEVICES WITH SAFETY RETENTION SUITS FOR REDUCING BALLISTIC RISKS

BACKGROUND

1. Field of the Description

The present description relates, in general, to safe design and operation of animatronics and robots (or, more generally, "robotic devices"), and, more particularly, the description relates to a new non-invasive method (or system design) to reduce ballistic risks related to use of animatronics, robots, or any other robotic device with rapidly moving or heavy components.

2. Relevant Background

There are many situations and applications where robotic devices are positioned and operated in close proximity to humans. In one example, the presence of robots in the manufacturing environment has increased significantly in recent years, and these large robots often move very rapidly to perform their assigned work tasks with human technicians or workers in nearby spaces. In another example, animatronics and other robotic devices are provided in entertainment settings to perform for human audience members, and there is growing demand to enhance audience member's experiences (e.g., theme park visitors riding on a park ride being entertained by animatronics) by positioning robotic devices close to the humans observing their operations. In the near future, it is likely that robots will be present in many houses worldwide providing care to and performing service functions for residents of the houses.

As robots and humans continue to be in close proximity and begin to interact more frequently and in more settings, a number of safety concerns are raised that need to be addressed by robotic device and system designers, and a great deal of research is presently under way on human-robot collaboration and interaction. In one exemplary use case, a robot with one or more limbs with jointed members may be moving a limb from one position and configuration to another position and the same or a different configuration at rapid speeds, e.g., to replicate some dynamic motions made by a human or human-like character such as waving their arms back and forth. In the case of a mechanical failure such as at a joint, a part or component (e.g., a member or limb) of the robot could potentially break off and be thrown or launched as a projectile into a nearby space. Hence, the use of robots for interaction with humans or in locations proximate to spaces in which humans may enter can involve ballistic safety risks that need to be reduced or mitigated or, when possible, completely eliminated.

Presently, robotic device designers use a number of solutions or designs to address ballistic safety risks, but each of the present solutions is invasive, costly, complex, time consuming, and/or analytic intensive to implement. Because there is some probability a part of a robot could break off and become a projectile, engineers spend a lot of time analyzing every part of the robot to determine what could possibly happen upon a failure and then to try to prevent that identified result from occurring.

One solution to a possible projectile concern is simply to limit robot-to-human interactivity and/or proximity of robots to humans by moving the robotic device further and further away from human observers. This, however, is directly in conflict with the goal of achieving more and more interaction and providing robots that appear human like. A second solution is to operate the robotic devices at slow rates where projectiles are of less concern, but this results in a less desirable interaction experience as the robots often will be unable to replicate expected character movements. A third solution is to provide safety redundancy, which may involve providing two separate load paths instead of a single one for each component that could have a mechanical failure that could produce a projectile. This is a very invasive, complex, and analytic-intensive design approach that is rarely implemented. A fourth approach is to provide safety cables or the like on any component that could be launched or fall off upon a mechanical failure, but, again, this approach produces a much more complex robot design and requires significant analysis to properly implement.

Hence, there remains a need for a non-invasive method or design to mitigate the risks that humans could possibly be harmed by a projectile resulting from a mechanical failure of a robotic device. Preferably, such a non-invasive method of mitigating ballistic safety risks would not require that the robot be moved "out-of-range" of the humans, but, instead, would facilitate close or at least medium range human-robot interactions while being relatively simple (or non-complex) and inexpensive to implement in many environments or settings.

SUMMARY

The inventors recognized a need for continued and increased, close-proximity human-robot interactions, and, in response, the inventors developed a robot system designed to provide non-invasive mitigation of ballistic safety risks. The robot system includes a robotic device such as a robot, an animatronic character, a robot component performing a desired function, or any other electro-mechanical assembly functioning to provide dynamic tasks. Significantly, the robot system also includes a safety retention suit that covers and/or encloses one or more of the movable components or parts of the robotic device (e.g., an arm of a robot, a leg of an animatronic character, a body or torso of a robot actor, and so on).

The safety retention suit is uniquely formed of a fabric sheet or body of material chosen, in part, for its flexibility as well as durability to allow the part or the component of the robot enclosed within the suit to be able to move relatively freely or unhindered (e.g., resistance forces to movement below some predefined maximum value). Further, the safety retention suit includes one-to-many strands, threads, or cables (herein typically labeled "cables" for simplicity but not as a limitation) of a material chosen to move with the flexible material of the sheet/body of the suit when the enclosed/covered component or part of the robotic device is moving during standard operations. However, when a mechanical failure (such as a break of a joint or some other mechanical coupling member) occurs, the cables of the suit stretch but, as an overall unit, do not break or fail so as to retain any portions of the covered or enclosed robotic part or component within the safety retention suit.

For example, the cables may be arranged in a netting pattern (or as a mesh) in the body/sheet of flexible material, and the maximum force resulting from the mechanical failure may cause one or more of the cables to stretch beyond a breaking point but the netting pattern includes more than some predefined number of cables to adequately dissipate the ballistic energy of the potential projectile to retain the suit's integrity and contain the broken off part (so only a "potential" projectile). In some embodiments, the flexible material may also be relatively strong, e.g., a material such as Ultra-High Molecular Weight Polyethylene (UHMwPE) (available as Dyneema®) or the like, and have its threads woven in weave pattern so that it provides the desired flexibility. The cable may be material that is at least as strong as the threads of the flexible material of the suit's body/sheet, such as Dyneema® of a thread size equal to or greater than of the body/sheet's threads when Dyneema® is used or a synthetic fiber such as Kevlar® (which may be spun into a rope or "cable"), fine metal strands, or some other strong but flexible material, and the cables/fibers are integrated within the weave pattern of the flexible material of the sheet/body of the suit.

More particularly, a robot system is provided that is specially adapted to mitigate ballistic risks. The system includes a robotic device having components (or assemblies) with dynamic movements. The system also includes a safety retention suit including a body with one or more sections adapted to receive the components of the robotic device. The one or more sections are formed of a fabric that is configured to stretch from an at-rest state when the robotic device perform operations to perform the dynamic movements. Further, though, the fabric is configured to dissipate energy from the components upon a mechanical failure of the robotic device causing decoupling of one of the components or release of a part from one of the components.

In some embodiments, the fabric is formed with threads of a strong material woven into a flexible weave pattern. The strong material comprises high tenacity nylon or a synthetic fiber with a tensile strength greater than a tensile strength of nylon such as Kevlar, UHMwPE, or the like.

In other embodiments, the fabric is formed of a layer of a flexible material and a plurality of cables of a strong material integrated into the layer of the flexible material, the strong material having a tensile strength greater than the flexible material. In these implementations, the flexible material is polyester or a material that stretches at a greater rate under a force than polyester, and the strong material comprises high tenacity nylon or a material with a greater tensile strength than nylon. In these systems, the plurality of cables of the strong material may include a cable that fails upon application of a preset tensile force lower than required to cause other ones of the plurality of cables of the strong material to fail.

In still other embodiments, the fabric is formed of a pair of layers of a flexible material and a netting of cables, which is formed from a strong material having a tensile strength greater than the flexible material, is sandwiched between these layers of flexible material. Here, the flexible material may be polyester or a material that stretches at a greater rate under a force than polyester, and the strong material may be high tenacity nylon or a material with a greater tensile strength than nylon.

In these or other embodiments, the fabric of the sections or a seam between two of the one or more sections can include a set of sacrificial fibers that fail under tensile load prior to other fibers in the fabric. In other cases, one of the sections includes in the fabric a sensor line adapted to measure applied tensile forces when coupled to a sensor.

DETAILED DESCRIPTION

Figure 1:
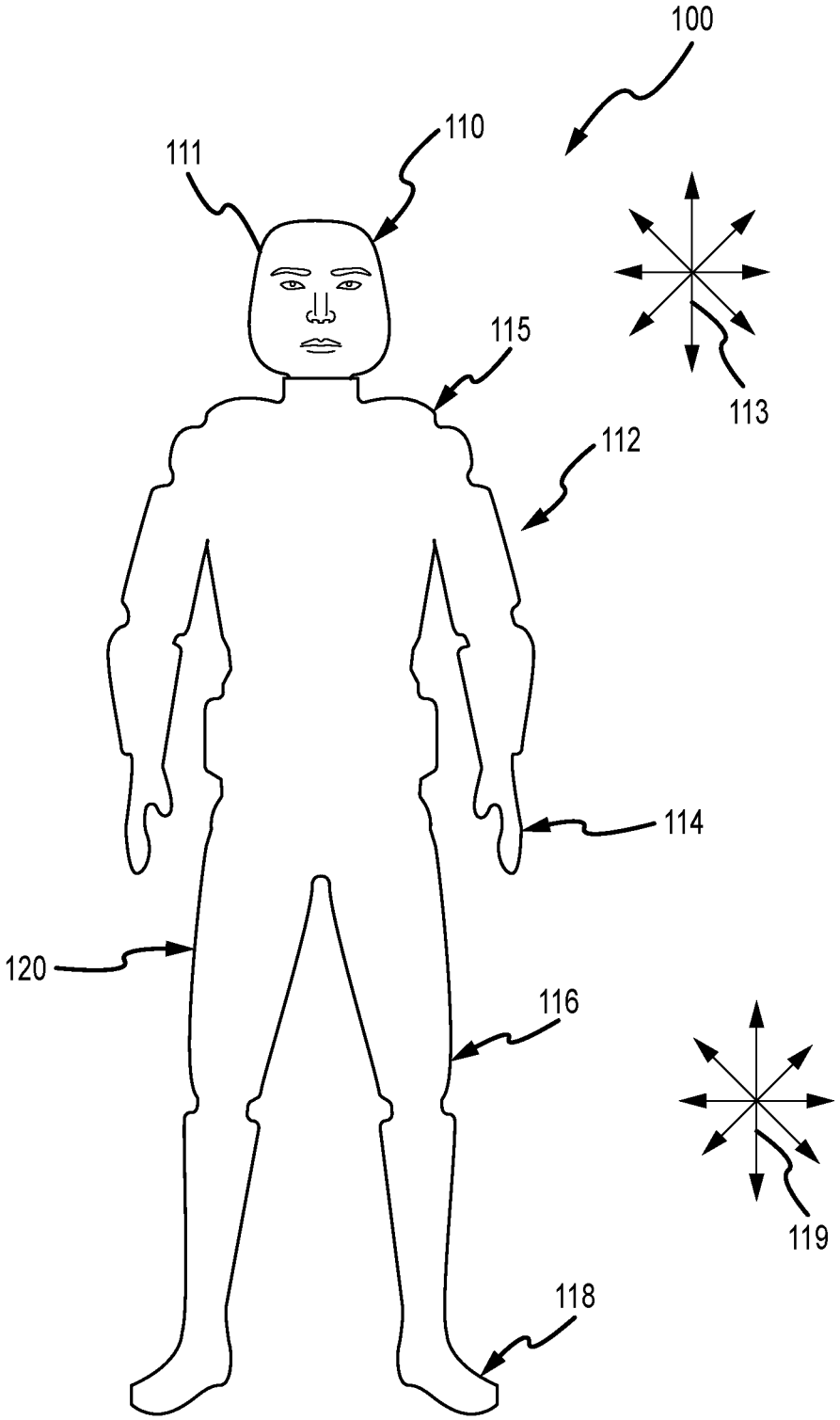
FIG. 1 illustrates a robot system including a robotic device contained within (or "wearing" or covered by) a safety retention suit fabricated according to the present description.

Briefly, a safety retention (or "super") suit is described for use with nearly any robotic device to reduce ballistic risks upon mechanical failure in a non-invasive manner. The robotic device may take nearly any form and may include animatronics, robots, and other robotic devices that include in their functionality rapid movement of components that, upon a failure or breakage such as at a joint or coupling, could potentially result in throwing or launching a part or section of the robotic device into the air as a projectile. To prevent or at least reduce the associated ballistic risks, the robotic device is covered or inserted into (or "wears") the new safety retention suit that functions to retain (or at least redirect or release with less energy) the part or section of the robotic device that, without the presence of the suit, would have been launched.

The safety retention suit can be installed over safety critical parts of a robot to prevent them from reaching humans surrounding the operating robot in case of failure. The suit is made of a flexible but strong material. The suit includes a body or sheet of the flexible and strong material that is configured to enclose the safety critical parts, e.g., a sleeve extending over an elbow joint or the like, a full body suit to enclose a torso of a human-like robot to enclose shoulder and other joints, and the like. The body/sheet of the flexible and strong material may be formed by weaving threads of a strong material, such as UHMwPE, in a flexible weave pattern. In the same or other embodiments, the body/sheet of the suit may be formed by integrating fibers or cables of a strong material (such as UHMwPE or a synthetic fiber such as Kevlar®) through a flexible material (such as UHMwPE interlaced with Kevlar® cables, elastane (available as Spandex or Lycra) or the like interlaced with UHMwPE, Kevlar®, or other material cables).

In other implementations, a rated net of the strong material fibers or cables may be integrated into one or more layers of flexible material, such as a synthetic fiber like Spandex, in a way that the one or more layers forming the body or sheet of the suit remain flexible until the net is stretched to a predefined stretch limit at which point no further stretching occurs and the contained robot parts are retained within the suit. In some of these embodiments, the suit's body or sheet may include carefully positioned sacrificial stitches that break to absorb energy in case of a failure of the robot wearing the suit. For example, stitches in the seam between a sleeve or a pant leg and a portion of the suit body/sheet covering the torso may be configured to absorb a predefined amount of energy and then break to reduce chances of flexible material in another portion of the suit tearing and releasing the contained robot parts.

The safety retention suit is configured to provide some or all of the following features: (a) it may be certified to resist a certain level of energy; (b) it may be assigned an inspection schedule when in use that can be designed to prevent wear from influencing the level of energy the suit can resist; (c) it wears in a predictable way and can, therefore, be changed out or repaired before becoming less effective than desired; (d) the fabric or body of the suit is flexible to allow the robot wearing the suit to move freely without adding too much resisting torque on the actuators; (e) the manufacturing method can be documented and controlled to ensure that every safety retention suit with the same design and formed of the same materials and parts has the same properties; (f) the fabric or body of the suit can be made out of a fire-retardant material to prevent fire originating from inside the suit to spread outside; and (g) the fabric or body of the suit can be made so that it is waterproof to protect the robotic elements from rain or water splashes.

FIG. 1 illustrates a robot system 100 including a robotic device 110 contained within (or "wearing" or covered by) a safety retention suit 120 that is fabricated according to the present description. In this exemplary system 100, the robotic device 110 is a human-like robot or animatronic with a head 111, a torso 115, a pair of arms 112 each coupled at the end with a hand 114, and a pair of legs 116 each coupled at the end with a foot 118. During operations of the robotic device 110, the arms 112 may move in three dimensions as shown with arrows 113 and, likewise, the legs 116 may move in three dimensions as shown with arrows 117.

Preferably, the safety retention suit 120 is configured, as discussed in one of fabrication approaches above, to be strong and flexible. Hence, this movement of the components of the robotic device 110 is possible, with resistance to movement (e.g., additional torque required for movement in the suit 120) being below a predefined maximum for the particular robotic device 110. This relatively free movement is practical even though these components of the robotic device 110 are enclosed within the suit 120 (with the head 111 left uncovered or non-enclosed). Particularly, the suit 120 is designed such that the hands 114 and feet 118 are enclosed within the body/sheet of the suit 120 so that if there were a failure at wrist or ankle joint these would be retained within the suit 120, as would the arms 112 if there is a failure at the shoulder joint and as would the legs 116 if there is a failure at the hip/pelvis or knee joint with the arms 112, torso 115, and legs 116 being positioned within the body/sheet of the suit 120.

Figure 2:
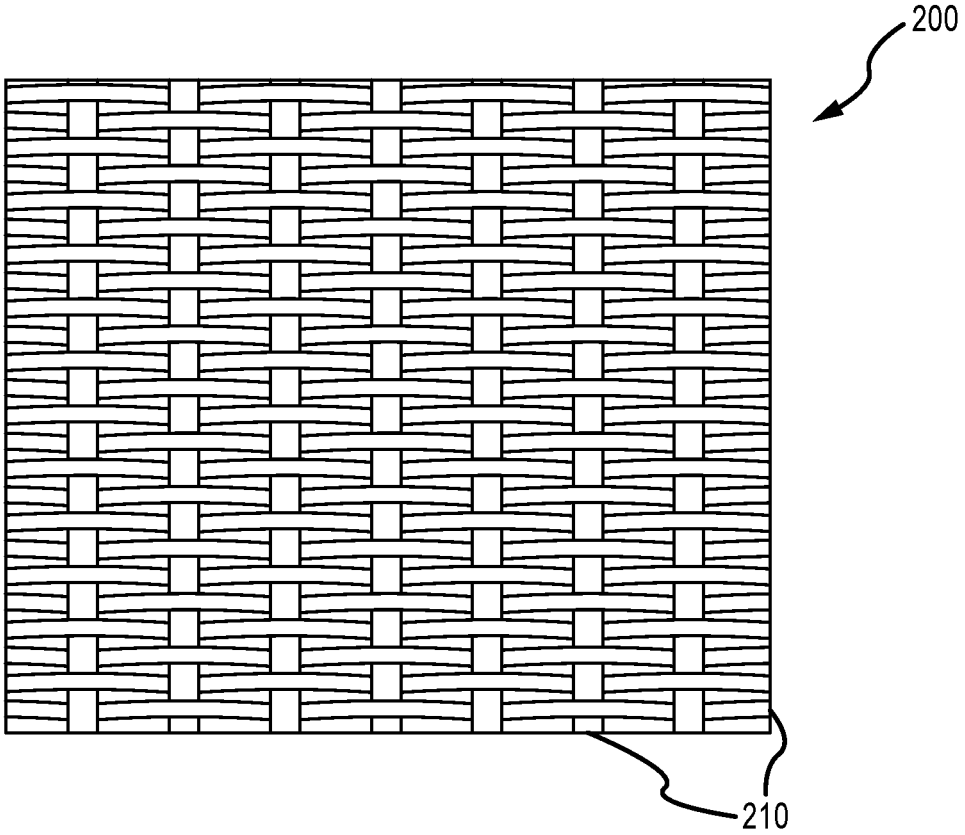
FIG. 2 shows an enlarged or magnified view of a portion of a body/fabric sheet of a safety retention suit made by providing fiber or threads of a strong material woven together in a flexible weave pattern.

As discussed above, there are a number of techniques that may be used to fabricate a safety retention suit of the present description (such as suit 120). One approach is to weave a strong material, such as UHMwPE (available as Dyneema®), in a flexible weave pattern to provide the fabric that can be sown together according to a pattern to provide a body/sheet of a safety retention suit (e.g., to provide arms, gloves, torso, legs, and stocking feet of the suit 120). FIG. 2 shows an enlarged or magnified view of a portion of a body/fabric sheet 200 of a safety retention suit made by providing fibers, threads, or cables 210 of a strong material woven together in a flexible weave pattern.

The body 200 (or fabric for sewing the suit's body) is formed, in this example, using a basket weave as this weave pattern provides a flexible but relatively strong fabric. Other weave patterns may be used in place of the basket weave such as a plain weave, a rib weave, a twill weave, a waffle weave, or another weave type or pattern that produces a fabric or material sheet that can be sown together to form a safety retention suit, and the weight and/or thicknesses of the threads or cables 210 of the strong material may be varied to achieve the desired flexibility with a selected flexible weave pattern concurrently with providing the desired energy absorption qualities (or strength). A particular thread/cable count for a chosen strong material may also be used to define or achieve desired flexibility and strength characteristics for the fabric/body 200. In some embodiments, the fabric 200 is tested to determine if, in addition to providing a desired flexibility, it is able to provide energy dissipation above a predefined value (e.g., a maximum energy of a potential projectile (robotic device part) to be contained within a suit formed of the fabric 200), and the fabric 200 will be modified to include stronger materials, a greater thread/cable count, and/or a different weave pattern until the testing is completed successfully.

Figure 3:
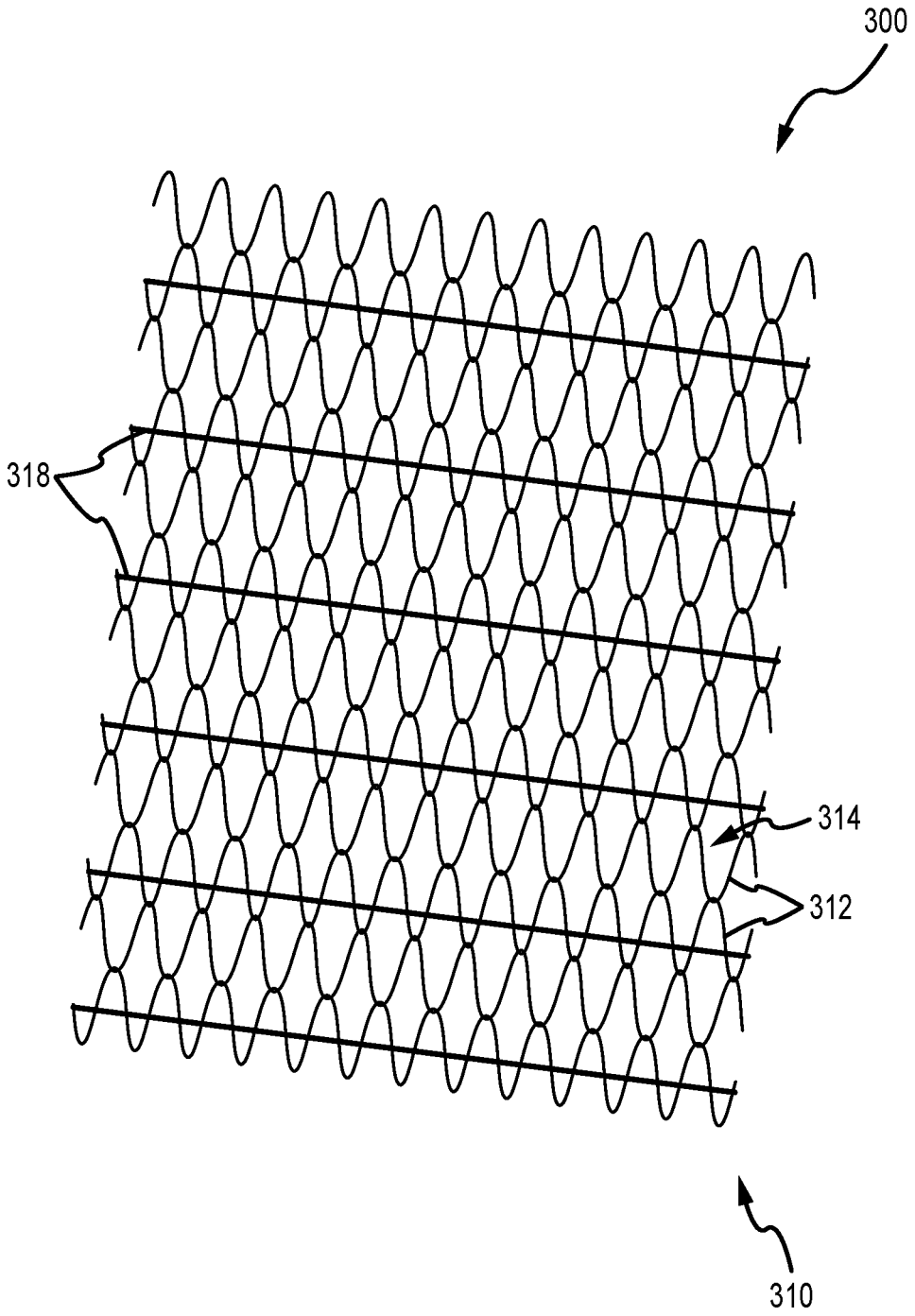
FIG. 3 is an enlarged or magnified view, similar to FIG. 2, of a portion of a body/fabric sheet of another safety retention suit made by integrating a plurality of threads or cables of a stronger material into a sheet or layer of flexible material.

FIG. 3 illustrates, with an enlarged or magnified view, a portion of another useful fabric/body 300 for forming a safety retention suit (such as suit 120 of FIG. 1). Fabric 300 is fabricated by integrating fibers of a strong material throughout a cross-section of a flexible material. The strong material may be high tenacity nylon, a natural or synthetic fiber with a strength (e.g., tensile strength) greater than nylon, and/or a strong synthetic fiber such as Kevlar® or UHMwPE (available as Dyneema®). Again, the thickness or weight of the fibers may be varied to achieve a desired energy dissipating capacity for each fiber and/or as a combined capacity in a portion of the fabric (e.g., strong fibers provided per inch of the fabric 300). The flexible material may be chosen from a large group of flexible materials (which may be defined by an amount of stretch prior to breaking when under a tensile force) that includes elastane (available as Spandex or Lycra).

As shown in FIG. 3, the fabric 300 for a suit includes a sheet 310 of threads 312 woven in a pattern that includes holes or gaps 314 between the adjacent threads 312. The weave pattern may be plain weave or some variation thereof or another weave allowing the sheet 310 to be adequately flexible to allow free movement (or movement with an acceptable amount of resistance) of a robot component contained in a suit of the fabric 300. To provide a desired amount of energy dissipation capacity in the fabric 300, a plurality of threads or cables 318 of the strong material (i.e., strong as or stronger (in tensile strength) than threads 312) are woven or positioned in the sheet 310 so as to extend through the holes/gaps 314 between the threads 312 in the sheet 310 (such as in an over and under pattern). The threads/cables 318 may be arranged to be parallel as shown, which may be useful if a failure is expected to apply forces on the fabric 300 along the longitudinal axes of the threads/cables 318. In other embodiments, additional threads 318 will be added to the fabric 300 and arranged to be transverse to the longitudinal axes of the shown threads 318, e.g., to be orthogonal to those shown.

Figure 4A:
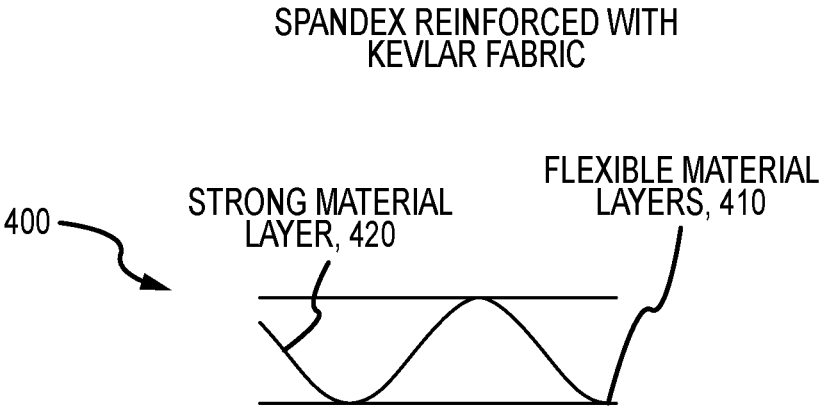
FIGS. 4A and 4B illustrate a side or end magnified view of another exemplary fabric for use in a safety retention suit in an at-rest state and after being stretched upon application of tensile loads.
Figure 4B:
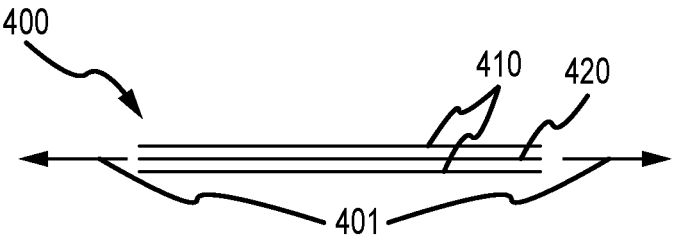

In order to stop the broken off or freed parts of a robot upon failure, the suit is designed to be able to absorb a lot of energy. However, to be easily installed on the robot and to allow the robot's enclosed components to move freely, the suit also needs to be able to deform under small loads. FIGS. 4A and 4B illustrate a side or end magnified view of another exemplary fabric 400 (or body of) a safety retention suit (such as suit 120 of FIG. 1) shown in an at-rest state and after being stretched upon application of tensile loads, respectively, as shown by arrows 401. As shown, the fabric 400 is made up of a pair of outer layers 410 formed of a sheets of flexible material, e.g., a synthetic fiber such as polyester (e.g., Spandex, Lycra, or the like), and a middle layer 420 of a stronger material, e.g., UHMwPE (available as Dyneema®), a strong synthetic fiber such as Kevlar®, or the like.

The strong material middle layer 420 may be provided as a plurality of non-linear cables or as a non-planar sheet. This configuration may be used in an at-rest state as shown for fabric 400 in FIG. 4A so that under relatively small loads the inner/middle layer 420 can be stretched to a more planar state with the flexible material outer layers 410 as shown in FIG. 4B. Once this linear or planar state is reached the body of the suit with fabric 400 will resist further stretching and act to absorb energy from the potential projectile part of the robot after failure so as to contain the part within a suit formed of the fabric 400. The suit fabric 400 may be thought of as integrating a really strong material inside two layers of stretchy material (e.g., Spandex reinforced with Kevlar® fabric or the like).

Figure 5A:
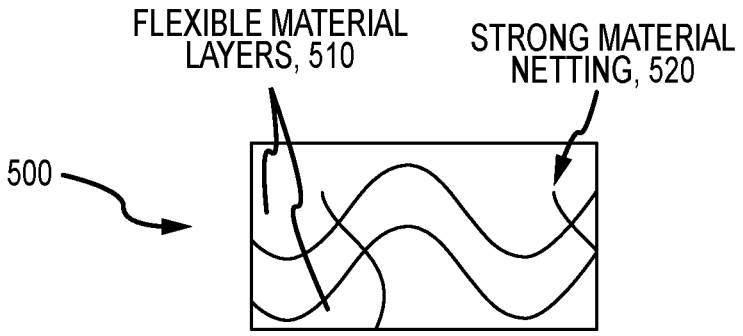
FIGS. 5A and 5B illustrate a side or end magnified view of yet another exemplary fabric for use in fabricating a safety retention suit in an at-rest state and a stretched state.
Figure 5B:
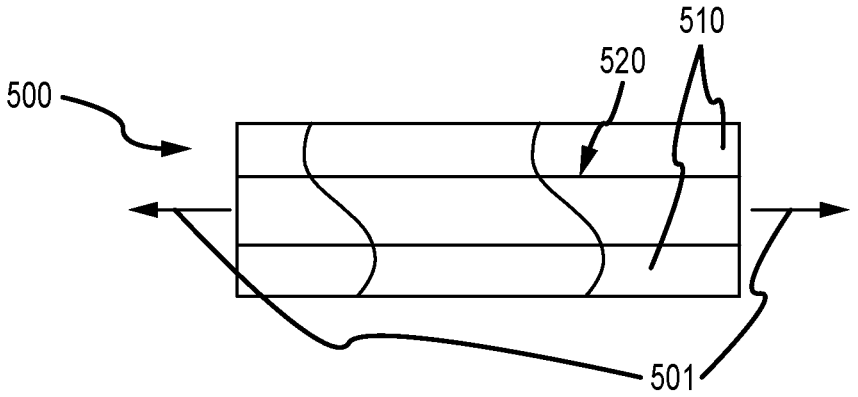

Another approach to making new fabric for the body of a safety retention suit involves integrating a really strong net inside two layers of stretchy material. Such an arrangement is shown in FIGS. 5A and 5B with fabric 500 shown in an at-rest state and in a state when tensile forces, as shown with arrows 501, are applied to stretch stretchy material and to deform the netting. As shown, the fabric 500 is formed with a netting 520 of strong material, e.g., UHMwPE (available as Dyneema®), a strong synthetic fiber such as Kevlar®, or the like, sandwiched between two outer layers 510 of flexible or stretchy material, e.g., polyester (e.g., Spandex, Lycra, or the like). The strands of the netting 520 become taut or tauter upon compression by forces 501 until they no longer readily deform with the stretchy layers 510 and begin to absorb energy from a potential projectile part of a robot wearing a suit with a body/sheet of the fabric 500.

As will be understood from the above discussion, a robot system is taught that includes a robotic device such as an animatronic or a robot and a safety retention suit that the robotic device wears. Here, "wears" means that the suit has a body with sections or portions each formed of sewn fabric that can receive one or more components of the robotic device to cover and/or enclose these components. The sections or portions of the suit body may be coupled together with stitched seams or in other ways. They can also be attached to the robot in certain areas. The fabric or sheets of material used for the suit body sections may be fabricated as discussed herein such as with a flexible material (or layers of flexible material) with a stronger material integrated into it or sandwiched between layers of the flexible material.

Figure 6:
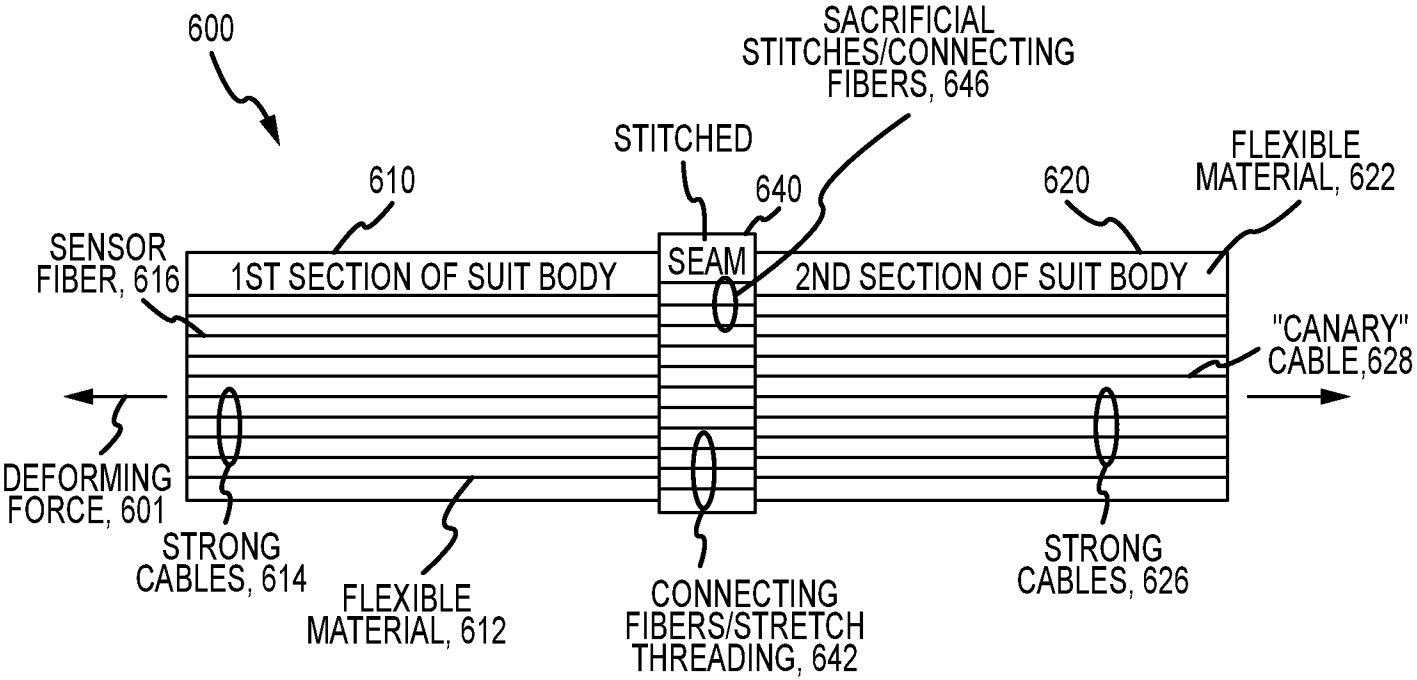
FIG. 6 is a functional block or schematic diagram of another embodiment of a safety retention suit of the present description.

FIG. 6 illustrates with a functional block diagram another implementation of a safety retention suit 600 of the present description. The body of the suit 600 includes a first section or portion 610 and a section or portion 620, and these are interconnected or coupled together via a stitched seam 640. The first and second sections 610, 620 are each adapted to receive and contain/cover one or more components of a robotic device, e.g., the first section 610 may receive an upper arm, an elbow joint, and a forearm of a robotic device and the second section 620 may receive a torso of a robotic device including the shoulder joint mechanically coupled to the upper arm. When a robotic device is positioned in within the suit 600 and operating, deforming or stretching forces 601 are applied by the contained robotic components on the suit sections 610, 620. Under normal operating conditions, the forces 601 merely stretch the sections 610, 620 allowing free movement of the contained components, but, under failure conditions, a potential projectile among the contained components applies greater forces 601 that the suit 600 is adapted to absorb so as to retain the potential projectile.

As shown, the first section 610 is formed of a fabric made up of one or more layers of flexible material 612 that has integrated within or sandwiched between a plurality of strong cables 614 (which may or may not be configured as netting). Further, though, the section 610 includes a sensor fiber 616 extending a length of the section 610 that would be communicatively coupled to a sensor (not shown) to allow the magnitude of the deforming force 601 to be sensed on an ongoing or periodic basis. This would allow a controller in the robot system using the suit 600 to sense when a failure has occurred, e.g., when the forces 601 exceed anticipated normal operating forces during robotic device movements, by processing the feedback provided by the suit 600.

The second section 620 is formed of a fabric made up of one or more layers of a flexible material 622 in which strong material cables 626 are integrated or sandwiched between. Further, the section 620 includes one or more "canary" cables 628, which are configured to fail (e.g., break) under a deforming force 601 that is less than that required to damage or cause failure of the strong material cables 626. The "canary" cable 628 is often provided in the section 620 in a manner or location that allows maintenance personnel to check its condition to quickly identify a failure or possible repair condition for the robotic device contained within the section 620.

The first and second sections 610, 620 are connected together by a stitched seam 640 of the body of the suit 600. This may include connecting fibers 642, which may be sewn through the flexible material 612, 622 and/or include strong cables linking cables 614 to cables 626. In the illustrated embodiment, the seam 640 is formed to include a set of stronger stitches 642 as well as one or more sacrificial stitches or connecting fibers 646, which are configured to fail under a smaller magnitude tensile or deforming force 601 than the fibers 642. In this way, a failure of a contained robotic component(s) of a robotic device can be selectively addressed such as by allowing failure of a portion of the seam 640 to direct a projectile in an acceptable direction after a predefined amount of ballistic energy is dissipated by the section 610 or section 620 (and/or by the seam 640 itself).

The described safety retention suit for robotic devices provides a solution to ballistic risks in a non-invasive manner by providing a wearable suit that can be safety rated. It provides a desirable solution in part because many applications already call for the robot or animatronics to wear an undersuit to protect a character-based costume such that the new suit can replace this undersuit. The suit's fabric often provides a hybrid material solution as the fabric is not simply super strong but is also very flexible. In some embodiments, the flexible base material does most of the work, but the inventors understood that strands or fibers are concentration of stress by definition. Hence, the fabric strands and then the strong threads/cables take out energy of the ballistic component or pendulum when it breaks.

The strength of the fabric for a safety rating can be determined as each strand has so much known energy dissipation capacity. As a result, a dynamic or ballistic part will have a predicted maximum energy and has to break "X" strands (e.g., strong cables if rating based solely on strong material additive in some cases) to escape a retaining section of a suit, and the fabric can be shown to include "X+1" (or, typically, many more than one) cables to be able to wholly dissipate the kinetic or ballistic energy of the potential projectile/disconnected robotic component so as to have a safety rating showing a suit formed of the fabric is proper for use with a particular robotic device.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

As will be apparent to the reader of this description, prior isolation methods do not allow a robot to fully interact with a crowd, as the robot will either be too far away or separated from the crowd, will be operated in an overly slow manner that is unrealistic, and/or will be not moving when humans are within some predefined proximity. In contrast, the new safety retention suit allows close distance interaction between humans and robots as do safety cables and redundant mechanical designs. However, use or wearing of the new suit provides a robot system that is lighter, less expensive, and more flexible than systems using the redundant mechanical design option. When compared with use of safety cables, the safety retention suit is: (a) not abrasive for other parts; (b) more flexible; (c) better at containing small parts; (d) external to the robot so the parts do not have to be designed to attach a safety cable; and (e) better at distributing the load.

The ballistic safety problem addressed by the safety retention suit is a problem that will likely come up eventually for the whole field of robotics, but today's interactive robots are so rare and so static that it has likely not yet been a concern for many in the robotics industry. Hence, in some ways, the inventors are addressing a need for companies that are ahead of the curve by at least a decade or two because their robots are in constant use in interactive ways and are very expressive with their movements (e.g., movements to replicate those of characters in movies or other media). Protective suits fabricated for human use differ from the new safety retention suits for robotic devices because the human suits are designed with different criterion in mind, especially since people do not tend to shed small parts as may be the case with a robot. One contribution provided by the inventors is being able to create a suit that is provably capable of capturing potential projectile components with relatively low analysis overhead and without compromising the performance of the robotic device in a significant way. This minimizes the impact of this critical safety concern on robot design, whereas trying to address the ballistic risks currently can be prohibitively expensive.

Figure 7B:
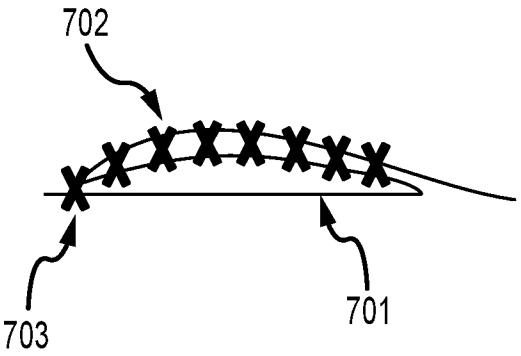
FIGS. 7A and 7B illustrate techniques for fabricating or assembling a safety retention suit of the present description.
Figure 7A:
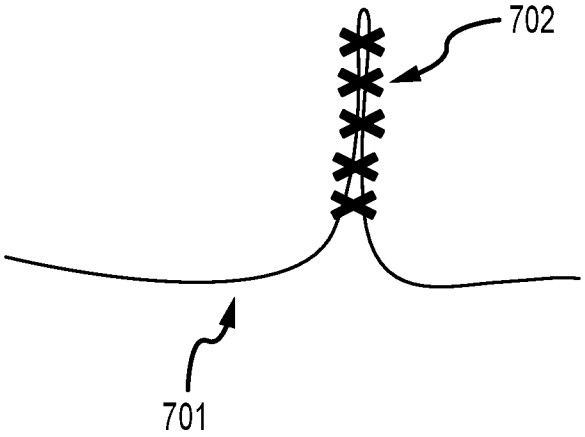

FIGS. 7A and 7B illustrate another technique for fabricating a safety retention suit or a feature for such a suit. Particularly, another strategy that can be used to allow the suit to absorb the energy of a part is to introduce an amount of weaker material that will break when exposed to a known force and, therefore, dissipate the energy from the part (that may have broken off or come loose from a robotic character wearing the suit). FIGS. 7A and 7B illustrate a concept following this strategy. A safety retention suit covers the robotic system and is made out of a base material 701 such as polyester or the like. A weaker material providing the joining material (702) is used to join together an excess of base material 701.

In FIGS. 7A and 7B, this is represented by many stitches of the joining material 702 that will break under a known force. This excess of material 701 can then be folded or stitched back to the base material to obtain a more compact design, such as shown in FIG. 7B with the presence of a seam 703 used to attach the excess of material 701 back to the rest of the suit. When a part breaks off, the base material 701 will stretch and, therefore, exert a bigger and bigger force on the connecting material (or stitches of such material) 702. If this force becomes higher than the maximal rated force of the stitches, they will start to break one by one, absorbing some energy in the process. This system is designed so that there are more stitches 702 than required to completely absorb the energy of the projectile. The projectile will, therefore, be stopped (or retained within the suit) and because the excess of material 701 is now unfolded, the part will dangle farther from the robotic system, potentially even laying on the ground. If the robotic system does not shut down and the robot continues to move, the part will not move as much, reducing the risks of hitting a human in proximity.

This is only one example of how to integrate sacrificial material to the suit, and many other configurations could be used. The sacrificial material is represented here as stitches that break off when exposed to a known force, but it could also be provided in or on a safety retention suit using other methods of integrating materials together such as by using glue.

We claim:

1. A robot system adapted to mitigate ballistic risks, comprising:

a robotic device comprising components with dynamic movements; and a safety retention suit comprising a body with one or more sections adapted to receive the components of the robotic device, wherein the one or more sections are formed of a fabric that is configured to stretch from an at-rest state when the robotic device perform operations to perform the dynamic movements, wherein the fabric is configured to dissipate energy from the components upon a mechanical failure of the robotic device causing decoupling of one of the components or release of a part from one of the components, and wherein the fabric comprises a layer of a flexible material and a plurality of cables of a strong material integrated into the layer of the flexible material, the strong material having a tensile strength greater than the flexible material.

2. The system of claim 1, wherein the fabric comprises threads of a strong material woven into a flexible weave pattern.

3. The system of claim 2, wherein the strong material comprises high tenacity nylon or a synthetic fiber with a tensile strength greater than a tensile strength of high tenacity nylon.

4. The system of claim 1, wherein the flexible material comprises polyester or a material that stretches at a greater rate under a force than polyester and wherein the strong material comprises high tenacity nylon or a synthetic fiber with a greater tensile strength than high tenacity nylon.

5. The system of claim 1, wherein the plurality of cables of the strong material includes a cable that fails upon application of a preset lower tensile force less than required to cause other ones of the plurality of cables of the strong material to fail.

6. The system of claim 1, wherein the fabric comprises a pair of layers of a flexible material and further comprises a netting of cables, formed from a strong material having a tensile strength greater than the flexible material, sandwiched between the layers of the flexible material.

7. The system of claim 6, wherein the flexible material comprises polyester or a material that stretches at a greater rate under a force than polyester and wherein the strong material comprises high tenacity nylon or a synthetic fiber with a greater tensile strength than high tenacity nylon.

8. The system of claim 1, wherein the fabric of the sections or a seam between two of the one or more sections comprises a set of sacrificial fibers that fail under tensile load prior to other fibers in the fabric.

9. The system of claim 1, wherein one of the one or more sections includes in the fabric a sensor line adapted to measure applied tensile forces when coupled to a sensor.

10. A robot system adapted to mitigate ballistic risks, comprising:

a robotic device comprising components with dynamic movements; and a safety retention suit comprising a body with one or more sections adapted to receive the components of the robotic device, wherein the one or more sections are formed of a fabric that is configured to stretch from an at-rest state when the robotic device perform operations to perform the dynamic movements, and wherein the fabric is configured to dissipate energy from the components upon a mechanical failure of the robotic device causing decoupling of one of the components or release of a part from one of the components, and wherein the fabric comprises a pair of layers of a flexible material and further comprises a netting of cables, formed from a strong material having a tensile strength greater than the flexible material, sandwiched between the layers of the flexible material.

11. The system of claim 10, wherein the fabric comprises threads of a strong material woven into a flexible weave pattern.

12. The system of claim 11, wherein the strong material comprises high tenacity nylon or a synthetic fiber with a tensile strength greater than a tensile strength of high tenacity nylon.

13. The system of claim 10, wherein the flexible material comprises polyester or a material that stretches at a greater rate under a force than polyester and wherein the strong material comprises high tenacity nylon or a synthetic fiber with a greater tensile strength than high tenacity nylon.

14. The system of claim 10, wherein one of the one or more sections includes in the fabric a sensor line adapted to measure applied tensile forces when coupled to a sensor.

15. A robot system adapted to mitigate ballistic risks, comprising:

a robotic device comprising components with dynamic movements; and a safety retention suit comprising a body with one or more sections adapted to receive the components of the robotic device, wherein the one or more sections are formed of a fabric that is configured to stretch from an at-rest state when the robotic device perform operations to perform the dynamic movements, wherein the fabric is configured to dissipate energy from the components upon a mechanical failure of the robotic device causing decoupling of one of the components or release of a part from one of the components, and wherein the fabric of the sections or a seam between two of the one or more sections comprises a set of sacrificial fibers that fail under tensile load prior to other fibers in the fabric.

16. The system of claim 15, wherein the fabric comprises threads of a strong material woven into a flexible weave pattern.

17. The system of claim 16, wherein the strong material comprises high tenacity nylon or a synthetic fiber with a tensile strength greater than a tensile strength of high tenacity nylon.

18. The system of claim 15, wherein one of the one or more sections includes in the fabric a sensor line adapted to measure applied tensile forces when coupled to a sensor.

* * * * *